United States Patent [19]

Morris

[11] 4,373,142

[45] Feb. 8, 1983

[54] THERMIONIC ENERGY CONVERTERS

[75] Inventor: James F. Morris, Fairview Park, Ohio

[73] Assignee: The United States of America as represented by the Administrator of the National Aeronautics and Space Administration, Washington, D.C.

[21] Appl. No.: 235,797

[22] Filed: Feb. 19, 1981

[51] Int. Cl.[3] ..... H01J 45/00

[52] U.S. Cl. ..... 310/306

[58] Field of Search ..... 310/306

[56] References Cited

U.S. PATENT DOCUMENTS

| | | | |
|---|---|---|---|
| 2,980,819 | 4/1961 | Feaster | 310/306 X |
| 3,138,725 | 6/1964 | Houston | 310/306 |
| 3,194,989 | 7/1965 | Garbury et al. | 310/300 |
| 3,202,843 | 8/1965 | Hurst | 310/306 |
| 3,218,196 | 11/1965 | Jensen et al. | 310/306 X |
| 3,470,393 | 9/1969 | Moncorge | 310/306 |
| 3,551,727 | 12/1970 | Jensen et al. | 313/346 |
| 3,558,935 | 1/1971 | Gritten et al. | 310/4 |
| 3,793,542 | 2/1974 | Defranould et al. | 310/4 |
| 3,843,896 | 10/1974 | Rason et al. | 310/4 |

*Primary Examiner*—Donovan F. Duggan

*Attorney, Agent, or Firm*—N. Musial; J. Manning; G. Shook

[57] ABSTRACT

This invention is concerned with improving the efficiency of thermionic energy converters. The invention is particularly directed to the reduction of plasma losses in these converters.

This beneficial technical effect is achieved by internal distribution of tiny shorted cesium diodes driven by the thermal gradient between the primary emitter (10) and the collector (12). Specifically, the tiny, shorted diode distribution (14) comprises protrusions of the emitter material (16) from the main emitter face (18) which contact the main collector face (22) thermally but not electrically. The main collector ends (20) of the protrusions are separated from the main collector by a thin layer of insulation (24), such as aluminum oxide.

The diode effect will increase with the use of metals that adsorb cesium less readily for the main emitter ends of the tiny protrusions and metals that adsorb cesium more readily for the main collector ends of the protrusions. By way of example, the main emitter can be made of rhenium or irridium; the main emitter ends of the protrusions can be made of tantalum or niobium; and the main collector ends of the protrusions can be made of platinum or irridium.

The shorted tiny diode distribution augments cesium ionization through internal thermal effects only within the main diode. No electrical inputs are required. This ionization enhancement by the distribution of the tiny shorted diodes not only reduces the plasma voltage drop but also increases the power output and efficiency of the overall thermionic energy converter.

10 Claims, 4 Drawing Figures

THERMIONIC ENERGY CONVERTERS

ORIGIN OF THE INVENTION

The invention described herein was made by an employee of the United States Government and may be manufactured and used by or for the Government for governmental purposes without the payment of any royalty thereon or therefor.

TECHNICAL FIELD

This invention is concerned with high efficiency thermionic conversion for space and terrestrial applications. The invention is particularly directed to the reduction of plasma losses in thermionic energy converters.

BACKGROUND ART

Jensen et al U.S. Pat. No. 3,551,727 discloses a low work function composite surface for the collector electrode of a thermionic converter which comprises a refractory metal such as rhenium or tantalum. Gritton et al U.S. Pat. No. 3,558,935 discloses a number of series connected thermionic converters having mating protrusions extending from both the emitter and the collector surfaces.

Defranould et al U.S. Pat. No. 3,793,542 describes a thermionic converter structure which utilizes aluminum oxide insulation between the emitter and collector. Rason et al U.S. Pat. No. 3,843,896 teaches the use of a radioisotope fuel pellet that is enclosed in a capsule for an atomic diode battery or thermionic converter. The capsule has an emitter surface extending over substantially the entire capsule external area.

DISCLOSURE OF INVENTION

Thermionic energy conversion is improved by providing better electrodes and reducing interelectrode (plasma) losses. This invention relates to reducing plasma losses with an internal distribution of shorted cesium minidiodes driven by the thermal gradient between the primary emitter and the collector. The shorted minidiode distribution comprises protrusions of the emitter material from the main emitter face which are in substantial juxtaposition with the main collector face and communicate with the collector thermally but not electrically.

The main collector ends of the protrusions are separated from the main collector by a thin layer of insulation. The diode effect increases with the use of metals that adsorb cesium less readily for the main emitter ends of the tiny protrusions and metals that absorb cesium more readily for the main collector ends of the protrusions.

This invention utilizes the large temperature difference between the emitter and the collector of a cesium thermionic converter to generate small shorted-diode discharges distributed throughout the interelectrode gap of the main or overall thermionic converter. The shorted minidiode distribution augments cesium ionization through internal thermal effects only within the main diode. No electrical inputs are required. This ionization enhancement by the distribution of shorted minidiodes not only reduces the plasma voltage drop but also increases the power output and efficiency of the overall thermionic converter.

BRIEF DESCRIPTION OF THE DRAWINGS

The details of the invention will be described in connection with the accompanying drawings wherein.

BEST MODE FOR CARRYING OUT THE INVENTION

Figure 1:
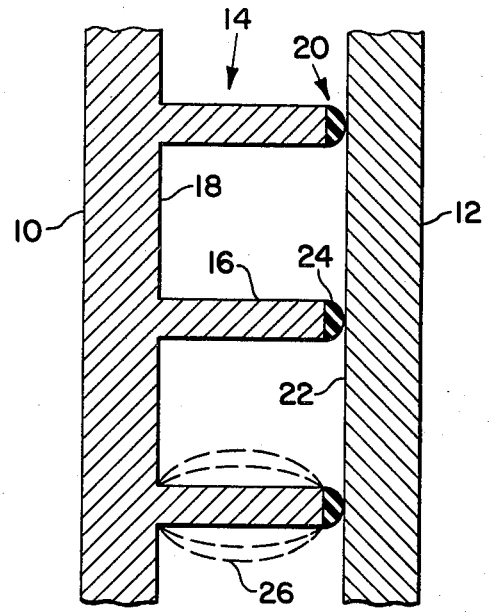
FIG. 1 is an enlarged sectional view of an emitter and collector of a thermionic energy converter embodying the preferred features of the invention.
Figure 2:
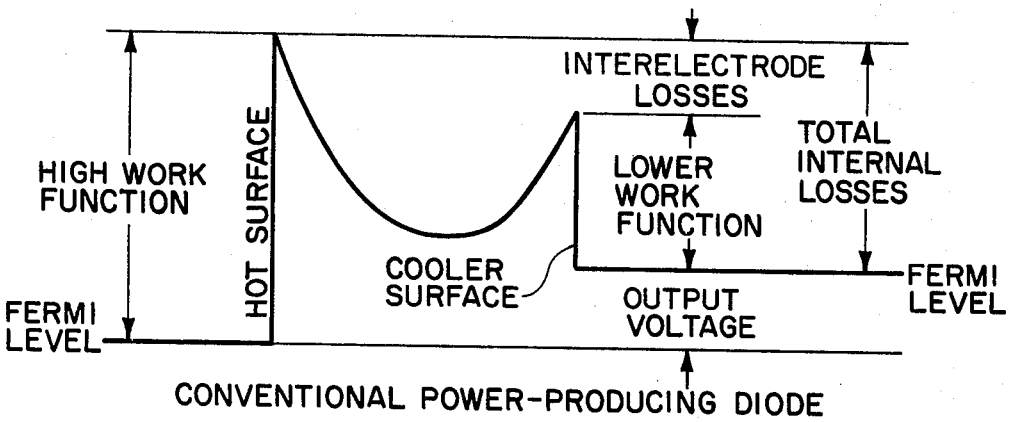
FIG. 2 is a qualitative electron-motive diagram for a conventional power-producing thermionic energy converter.

Referring now to the drawings there is shown in FIG. 1 a portion of a cesium thermionic converter having a pair of spaced electrodes. One of the electrodes is an emitter 10 and the other is a collector 12. As shown in FIG. 2 present day thermionic energy converters have interelectrode losses near 0. volt with total internal losses near 2 volts.

According to the present invention the emitter 10 has a minidiode distribution 14 which comprises protrusions 16 of emitter material extending from the main emitter face 18. The outermost ends 20 of the protrusions 16 are adjacent to the main collector surface 22 and in thermal communication therewith through thin local layers of electrical insulation 24. The layers of insulation 24 may be replaced by very thin gaps of the partial vacuum immediately contiguous to the primary collector surface 20. It is also contemplated that the protrusions 16 could extend from the collector 12 toward the emitter 10 and be in communication with the emitter thermally but not electrically.

The protrusions 16 are relatively small in cross-section compared to their lengths. More particularly, the main diode gap between the emitter 10 and the collector 12 is preferably several mils to several tens of mils wide. Thus, the minidiodes are usually several mils to several tens of mils long and usually a half to a full order of magnitude smaller in diameter.

The insulation 24 is thermally conductive but not electrically conductive. Thus, the ends of the protrusions 16 essentially are in communication with the main collector surface 22 thermally but not electrically.

The distributed shorted minidiodes are shown as being identical and equally spaced in FIG. 1 for simplicity. These minidiodes are ideally distributed with about two ion-diffusion path lengths between two minidiodes. But the inter-minidiode spacing can vary considerably from the ideal and still provide for enhancement.

The protrusions 16 may be metallic crystal whiskers grown by vapor deposition and cut off at suitable identical lengths by electrochemical processes. The protrusions 16 are then capped by dipping the outermost ends 22 into molten insulating material 24 or by vapor depositing the insulating material on the ends of the minidiodes.

The ends 20 approach the collector temperature, adsorb cesium readily, and develop low work functions.

Figure 3:
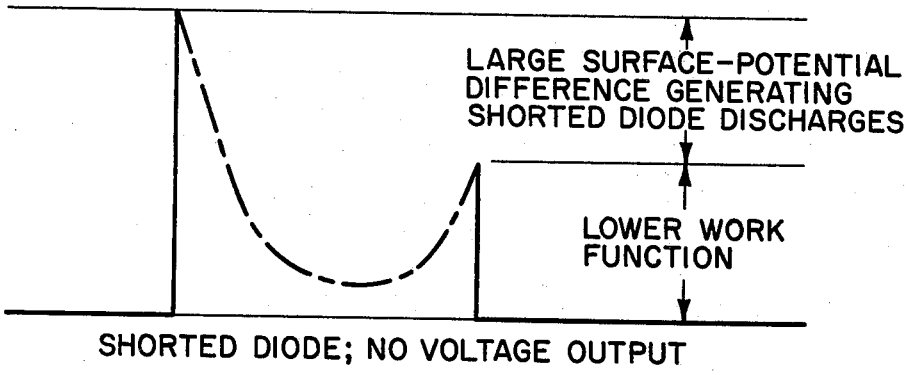
FIG. 3 is a qualitative electron-motive diagram for an ion-producing shorted diode thermionic energy converter.
Figure 4:
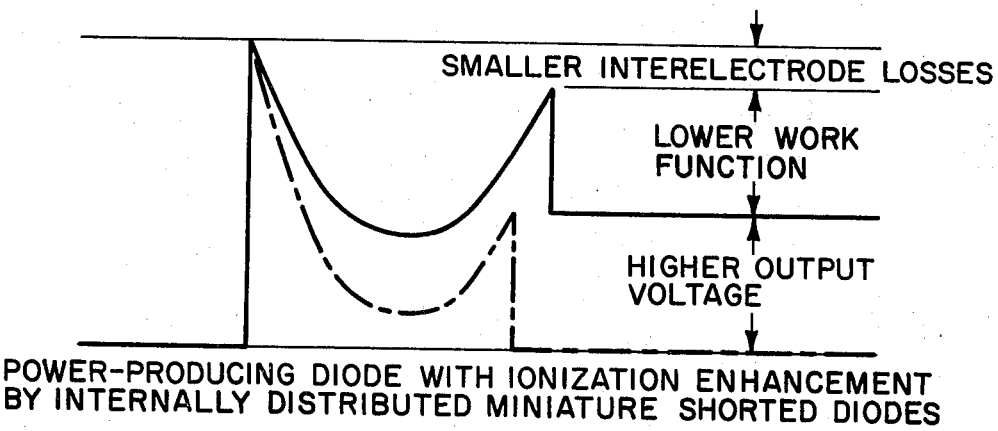
FIG. 4 is a qualitative electron-motive diagram similar to FIGS. 2 and 3 for a power-producing primary thermionic energy converter with distributed intragap ion-producing shorted thermionic energy converter minidiodes which embodies the features of the invention to produce greater voltage and power outputs.

The protrusion surfaces nearer the main emitter face 18 are hotter, adsorb less cesium, and have high work functions as shown in FIGS. 3 and 4. It will be appreciated that at the main emitter face 18 the temperatures, adsorbed cesium, and work functions of the protrusions 16 and the main emitter 10 are similar. Thus, the main-emitter ends of the protrusions 16 are hot and have high work functions, as shown in FIGS. 2, 3 and 4.

In contrast, the main-collector ends 20 of the protrusions are cooler and have much lower work functions as shown in FIGS. 3 and 4. Also, the main-collector ends 20 of the protrusions 16 are electrically insulated from the main collector 12 but are electrically shorted to the main emitter 10 through the protrusions themselves. Of course, the main emitter 10 is not electrically shorted to the main collector 12 through the minidiodes or otherwise.

In FIG. 3 the internal voltage drop exceeds that of the power producing diode of FIG. 2. This produces much greater ionization. Ion currents to the emitter 10 can be about one-third the electron emission in shorted diodes.

Low pressure cesium surrounds the protrusions 16. Thus, conditions are excellent to generate shorted-diode discharges 26 along the distributed protrusions as shown in FIG. 1. The resulting distributed shorted-diode discharges 26 ionize the cesium far more effectively than would the overall converter without the internal shorted-diode distribution 14. With this shorted diode distribution, lower cesium pressures used with more effective electrodes can still provide effective neutralization for the emitter electron current. This is accomplished with less losses for plasma generation, electron collisions, and thermal conduction in the cesium that is in the main interelectrode gap. Less losses yield greater power outputs and higher efficiencies for the overall converter, as shown in FIG. 4.

The shorted diode effect will increase with the use of metals that adsorb cesium less readily for the main-emitter (higher temperature) ends of the tiny protrusions 16 and metals that absorb cesium more readily for the main-collector (lower temperature) ends 20 of the protrusions 16. By way of example, the main emitter 10 may be rhenium or iridium; the main-emitter ends of the protrusion 16 may be tantalum or niobium; the main-collector ends 20 of the protrusions may be platinum or iridium separated by a thin layer 24 of aluminum oxide, silicon carbide, or boron nitride from the main collector 12. SiC and BN may be less compatible with cesium than $Al_2O_3$.

For generally acceptable thermionic converter conditions, the tantalum will produce higher work functions at the main-emitter ends of the protrusions 16. Also, the platinum will produce lower work functions at the main-collector ends 20 of the protrusions 16 than will rhenium alone used throughout the protrusions.

It is further contemplated the tantalum, platinum combination will produce greater surface-potential differences to generate shorted-diode discharges than will rhenium alone used throughout the protrusions 16. However, rhenium alone is very effective under many conditions and is preferred for its simplicity. Tungsten, as well as other suitable electrode materials for thermionic energy conversion, can also be used.

The shorted minidiodes induce higher cesium concentrations in the regions of their discharges and seek available and most optimum cesium-pressure, interelectrode-distance combinations for their discharges 26. This enables the minidiodes to generate cesium ions more efficiently thereby providing a lower cesium pressure in the main interelectrode gap between the primary emitter 10 and collector 12. The shorted minidiodes 16 allow lower levels of cesium-pressure, interelectrode-distance combinations between the primary emitter and collector which results in lower collisional losses for electron emission from the primary emitter because of interelectrode cesium encounters.

In addition to providing miniaturized ion sources that are uniformly distributed between the main emitter and collector of the primary thermionic energy converter, it is contemplated the distributed shorted minidiodes 16 enable this converter to be productively operated at considerably lower cesium pressures. This is based on the fact that the small shorted diode discharges 26 occur immediately adjacent to the surfaces of the distributed small protrusions 16 whereby the effective cesium concentration will be much higher in these shorted-discharge regions than it is in general in the overall interelectrode gap between the main emitter 10 and collector 12. Even without the shorted-diode discharge 26 the vapor distribution is considerably different within a few mean free path lengths of a wall of a protrusion 16 from that in the main volume of the vapor.

The sheaths of the shorted-diode discharge 24 accelerate positive ions from the plasma region toward the shorted-diode emitter and collector regions. The ion flow to the shorted-diode emitter can approach one-third of its electron emission. In addition to this high arrival rate of positive cesium ions at the emitter, their flow also collisionally moves neutral cesium atoms toward the electrode surfaces. These same sheaths prevent escape of positive ions from the electrode regions to the plasma.

These mechanisms tend to produce much higher cesium concentrations near the surfaces of the protrusions 16 than in the main interelectrode gap. Also, the shorted-diode discharges 26 will tend to seek the paths near the surfaces of these protrusions 16 that afford the best available local combinations of cesium pressure and interelectrode distance for arc maintenance.

While the preferred embodiment of the invention has been described various modifications may be made without departing from the spirit of the invention or the scope of the subjoined claims.

I claim:

1. In a cesium thermionic energy converter of the type comprising a diode having a pair of spaced electrodes with an interelectrode gap therebetween containing cesium wherein one of said electrodes is an emitter having a first elevated temperature and the other is a collector having a second elevated temperature lower than said first temperature, the improvement comprising a plurality of minidiodes comprising protrusions of electrode material extending from the surface of one of said electrodes, said minidiodes being distributed in the interelectrode gap with the outermost ends thereof being adjacent to the other of said electrodes so that said minidiodes are in thermal communication with both said electrodes whereby the end of each minidiode adjacent to said collector is raised to said second temperature thereby readily adsorbing cesium and developing a low work function and the end of each minidiode adjacent to said emitter is raised to said first temperature thereby adsorbing less cesium and developing a high work function, and means for electrically insulating said minidiodes from one of said electrodes whereby shorted-diode discharges are generated along said minidiodes to effectively ionize the cesium without electrically shorting said emitter to said collector.

2. An improved thermionic energy converter as claimed in claim 1 wherein the minidiode distribution comprises protrusions of emitter material extending from the surface of the emitter electrode.

3. An improved thermionic energy converter as claimed in claim 1 wherein the minidiode distribution comprises protrusions of collector material extending from the surface of the collector electrode.

4. An improved thermionic energy converter as claimed in claim 1 wherein the ends of the protrusion remote from the electrode from which they extend are covered with a material that is electrically insulating and thermally conductive.

5. An improved thermionic energy converter as claimed in claim 1 wherein the ends of the protrusions remote from the electrode from which they extend are electrically insulated from the other electrode by thin gaps of partial vacuum.

6. An improved thermionic energy converter as claimed in claim 1 wherein the interelectrode gap contains cesium and the protrusions extend from the emitter electrode, the ends of the protrusions adjacent to said emitter electrode being of a material that adsorbs cesium less readily, the ends of the protrusions adjacent to the collector electrode being of a material that adsorbs cesium more readily.

7. An improved thermionic energy converter as claimed in claim 6 comprising an emitter electrode of a material selected from the group consisting of rhenium and iridium, and protrusion having end portions adjacent to said emitter of a first material and end portions adjacent to the collector electrode of a second material.

8. An improved thermionic energy converter as claimed in claim 7 wherein the first material is selected from the group consisting of tantalum and niobium.

9. An improved thermionic energy converter as claimed in claim 7 wherein the second material is selected from the group consisting of platinum and iridium.

10. An improved thermionic energy converter as claimed in claim 7 wherein the ends of the protrusions are separated from the collector electrode by a thin layer of a material selected from the group consisting of aluminum oxide, silicon carbide, and boron nitride.

* * * * *